US007121307B2

(12) United States Patent
Nasiatka et al.

(10) Patent No.: US 7,121,307 B2
(45) Date of Patent: Oct. 17, 2006

(54) MANUAL CRIMPING TOOL FOR PLASTIC STRAP

(75) Inventors: Jason R. Nasiatka, Northbrook, IL (US); Janusz Figiel, Mundelein, IL (US); David E. Crittenden, Schaumburg, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 35 days.

(21) Appl. No.: 10/847,075

(22) Filed: May 17, 2004

(65) Prior Publication Data

US 2005/0252570 A1 Nov. 17, 2005

(51) Int. Cl.
*B21F 15/06* (2006.01)

(52) U.S. Cl. ..... 140/153

(58) Field of Classification Search ..... 140/93.2, 140/93.4, 150, 152, 153, 154; 81/416
See application file for complete search history.

(56) References Cited

U.S. PATENT DOCUMENTS

| | | | | | |
|---|---|---|---|---|---|
| 2,177,536 | A | * | 10/1939 | Porter | 140/153 |
| 2,891,432 | A | * | 6/1959 | Thornbery et al. | 140/154 |
| RE24,836 | E | * | 6/1960 | Hepler | 140/154 |
| 3,120,772 | A | * | 2/1964 | Mixon, Jr. | 72/409.14 |
| 3,200,675 | A | * | 8/1965 | Willis | 140/154 |
| 3,899,818 | A | * | 8/1975 | Castaneda et al. | 29/243.56 |
| 6,152,188 | A | * | 11/2000 | Barlasov | 140/153 |

* cited by examiner

*Primary Examiner*—Dmitry Suhol
(74) *Attorney, Agent, or Firm*—Mark W. Croll; Donald J. Breh; Levenfeld Pearlstein, LLC

(57) ABSTRACT

A crimping tool for installing a metal crimp seal onto overlapping layers of plastic strap material includes a tool head, at least three pairs of jaws disposed in the tool head and operably mounted thereto, each pair including opposingly oriented jaw elements and each pair being spaced from its adjacent pair, and at least two crimpers, one crimper disposed between adjacent pairs of jaw elements, the crimper extending between the jaw elements.

5 Claims, 2 Drawing Sheets

MANUAL CRIMPING TOOL FOR PLASTIC STRAP

BACKGROUND OF THE INVENTION

The present invention relates to a crimping tool for providing a metal crimp seal on plastic strapping. More particularly, the present invention relates to a side action crimping tool for sealing a metal crimp seal to plastic strapping that reduces the opportunity for damage to the plastic strap material.

Strapping material is used in wide variety of applications to secure or bundle loads. The strap material is typically metal or plastic and can be applied to the load using either a manual sealer or a powered sealer. Powered sealers can be pneumatic or electric and can be hand-held or machine-frame type machines. Non-powered (manual) sealers are typically hand-held or hand-operated tools.

The seals (for both metal and plastic strap) can be of the seal-less type or of the crimp seal type. In a seal-less seal or joint, the material is welded to itself (if plastic) or mechanically joined as by locking cuts and projections. Crimp seals, on the other hand, use a band that is bent or wrapped around overlapping portions of strap and mechanically crimped onto the strap. In such a joint, the seal is compressed onto the strap material and the strap material is deformed so as to be secured in the seal. Generally, the inside of the seal is coated with grit to increase the friction between the seal and the strap.

In many such seals, the seal is cut, at least in part and is urged into the material to create an interference type of fit. In this manner, portions of the strap and portions of the seal are forced from their respective bodies, into the other material. That is, the strap and seal are cut and bent into each other so that the materials are not only held by compression, but also by interference of the crimp seal with the strap "pulling" from the seal. While such an arrangement is acceptable for metal strapping material it is unacceptable for plastic strap in that the integrity of the plastic strap can be compromised by cutting the strap material.

To this end, crimp seal arrangements have been attempted with plastic strap without success. It has been found that without the cutting and attendant interferences created by the joint, the plastic strap simply pulls from the crimp seal. On the other hand, experience with the cutting and interference type of joint shows that the potential for strap material failure is too high.

Accordingly, there is a need for a manual crimp seal tool for use with plastic strap material. Desirably, such a tool is used to provide a high reliability crimp seal type of seal on overlapping plastic strap. Most desirably, such a tool provides the crimp seal without damage to the underlying strap material.

SUMMARY OF THE INVENTION

A crimping tool for installing a metal crimp seal onto overlapping layers of plastic strap material provides a high reliability metal crimp seal type of seal on overlapping plastic strap. Such a tool provides or installs the crimp seal without damage to the underlying strap material.

The tool includes a tool head having at least three pairs of jaws disposed in the tool head and operably mounted thereto. Each pair of jaws includes opposingly oriented jaw elements and each pair is spaced from its adjacent pair. At least two crimpers, with one crimper disposed between adjacent pairs of jaw elements is provided, the crimpers extending between the jaw elements. Preferably, the crimper is straight, extending straight between opposing sets of jaw elements and having a curved profile in cross-section.

A present tool includes three pairs of jaws, one being a central jaw pair and the others being terminal jaw pairs and includes two crimpers, one crimper positioned between the central jaw pair and one of the terminal jaw pairs and the other crimper disposed between the central jaw pair and the other of the terminal jaw pairs.

The tool preferably includes one tool operating handle operably connected to the tool head, and a stationary handle operably mounted to the head. In a present tool, a linkage operably connects each of the jaw elements of each pair of jaw elements and operably connects each of the jaw element pairs so that all of the jaw pairs open and close (operate) in unison and together with tool actuation. The linkage is operably connected to the tool operating handle.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
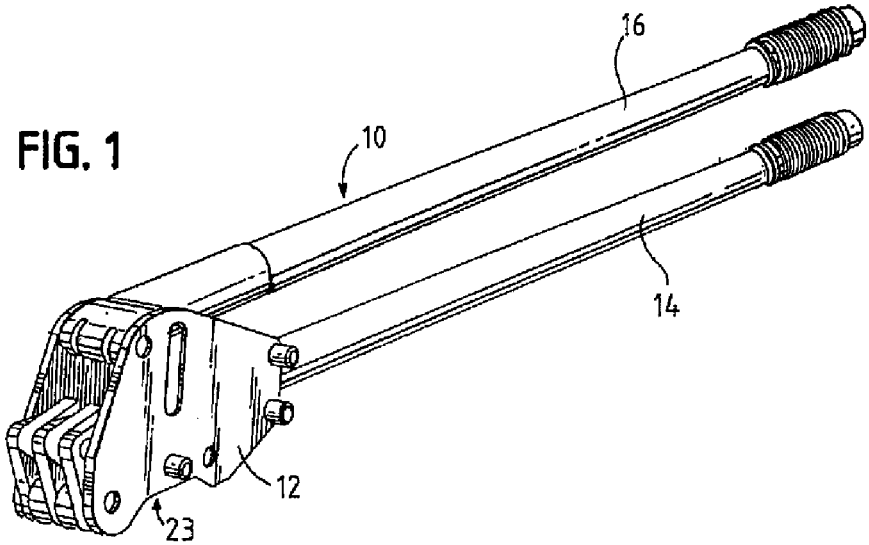
FIG. 1 is a perspective view of a side action crimping tool for plastic strap embodying the principles of the present invention.
Figure 2:
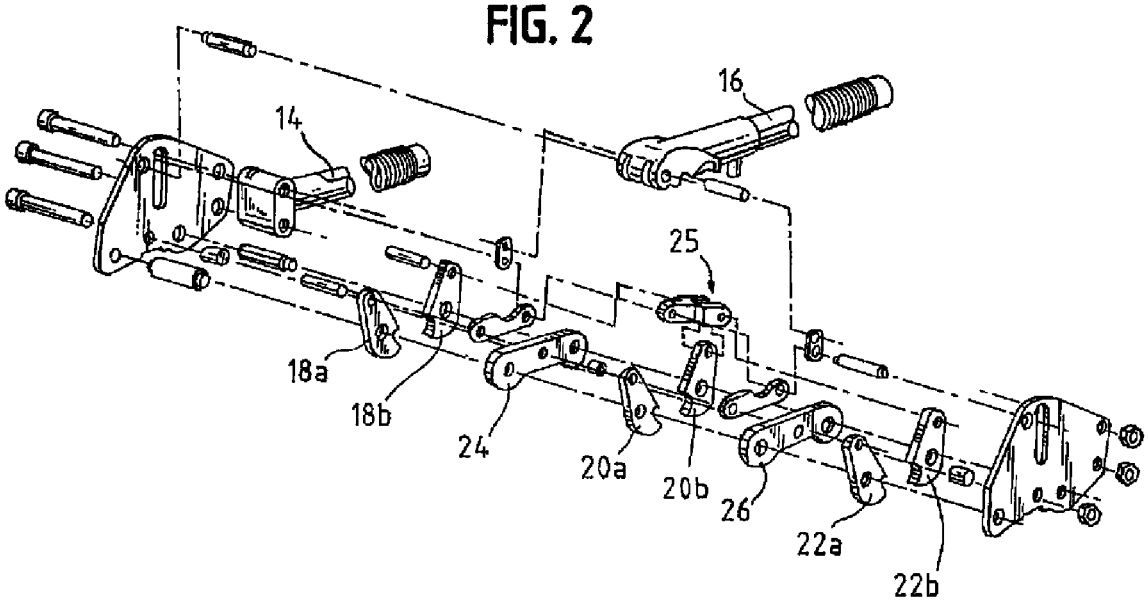
FIG. 2 is an exploded view of the tool of FIG. 1.
Figure 3A:
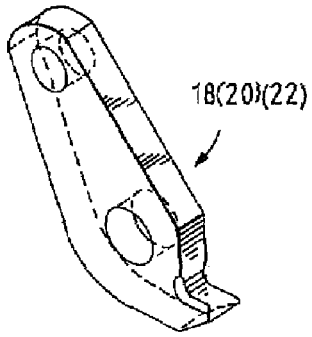
FIGS. 3A and 3B are perspective and enlarged views of one jaw element.
Figure 3B:
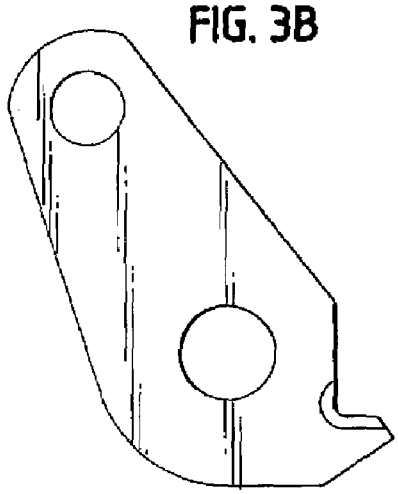
Figure 4A:
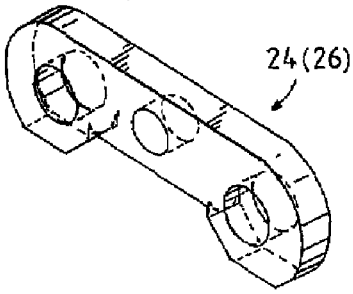
FIGS. 4A, 4B and 4C are perspective, enlarged and cross-sectional views, respectively, of a crimper.
Figure 4B:
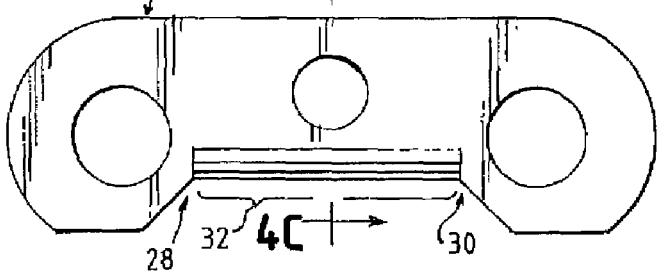
Figure 4C:
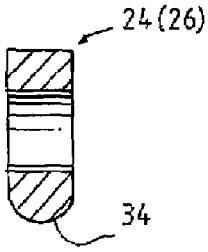

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a side action crimping tool 10 embodying the principles of the present invention. The tool 10 includes a head 12, a stationary handle 14 and a crimping or operating handle 16. As the names reveal, the stationary handle 14 is mounted, in a stationary manner, to the head 12 and provides for support and stability in using the tool 10, as well as assists in developing the leverage needed to operate the tool 10. The operating handle 16, on the other hand, is used to operate or actuate the tool 10. The present tool 10 is of the side action type in that one of the handles 16 actuates the tool 10 while the other is for stability and leverage and further that the tool 10 operates on strapping from the side of the head 12, rather than the top of the head.

The head 12 includes a plurality of movable jaw element sets or pairs 18*a,b,* 20*a,b* and 22*a,b,* and in fact at least three jaw element pairs. This is unlike known crimping tools that use only two pairs of jaw elements. The jaws 18–22 pivot between an open position in which the strap S and crimp seal C are positioned in the tool 10 (between the jaws, i.e., between jaws 18*a,* 20*a,* 22*a* and 18*b,* 20*b* and 22*b,* respectively) and a closed position in which the jaws 18–22 move inward to deform the seal C and compress the seal C onto the strapping material S thus forming the crimp seal. It will be appreciated that when the jaws 18–22 are open, the distance between the jaws (that is, the distance between jaw elements 18*a* and 18*b,* between elements 20*a* and 20*b* and between elements 22*a* and 22*b,* or the jaw opening 23) is (slightly) greater than the with of the crimp seal C, and that closing the jaws 18–22 moves the jaws toward one another.

A linkage arrangement, indicated generally at 25, in the head 12 operably connects the jaws 18–22 to one another and to the operating handle 16 so that pivoting the operating handle 16 away from the stationary handle 14 opens the jaws 18–22 and pivoting the operating handle 16 toward the stationary handle 14 closes the jaws 18–22. Such an arrangement is well known in the art and will be recognized by those skilled in the art.

Figure 5:
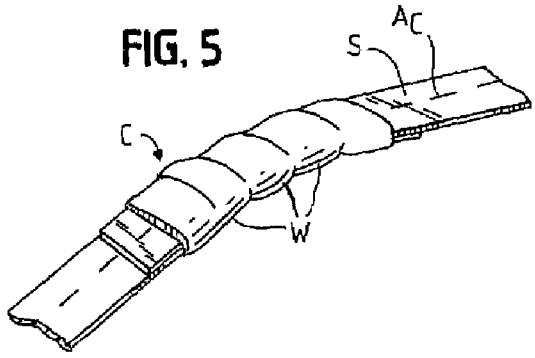
FIG. 5 illustrates a crimped joint formed using the crimping tool of the present invention.

In order to create joint, the seal C must not only be bent inward (or closed), onto the flat portions of the strap S, but also an undulation or "wave" like deformation is formed in the crimp seal C, transverse to the longitudinal axis of $A_C$ the seal C (see FIG. 5). In order to form this wave, as indicated generally at W, as seen in FIGS. 2 and 4A–4C, a crimper (two total) 24, 26 is positioned between adjacent pairs of jaw elements 18–22. A present tool includes two crimpers, one crimper 24 between the first and second pair of jaw elements 18, 20 and a second crimper 26 between the second and third pair of jaw elements 20, 22.

Again, unlike known tools which have two pairs of jaw elements and one crimper, the present tool includes three pairs of jaw elements 18–22 and two crimpers 24, 26. Thus, while the joint made using known tools is of a W-shape, a joint seal C made using the present tool 10 is a WW-shape (see FIG. 5). This provides a number of advantages, some of which are not readily apparent. First, the increased number of waves or undulations, increases the tortuousness of the path that a strap would have to follow in order to pull out of the joint. This, of course, increases the overall joint strength.

Additionally, the increased number of jaw pairs 18–22 and crimpers 24, 26 allows the use of straight crimpers 24 and 26, rather than known peaked crimpers. That is, as seen in FIGS. 2 and 4A–4C, the present tools uses crimpers 24 and 26 that are essentially straight across the tool or from the point 28 adjacent one jaw element, e.g., 18*a* of a pair, to a point 30 adjacent the other jaw element, e.g., 18*b,* of that pair. As such, in a present tool 10, the crimper 24, 26 is formed straight (as indicated at 32) from one jaw element to the other jaw element, and has a rounded profile in cross-section as indicated at 34 in FIG. 4C (transverse to the elongated direction).

This is quite unlike known tools which use a peaked crimper that essentially provides an anvil surface, about which the strap and seal are bent (and cut or torn) as the jaws compress and close the seal. It has been found that by increasing the number of jaw element pairs 18–22 (to at least three pairs) and accordingly increasing the number of crimpers 24, 26, the depth to which the crimps WW (FIG. 5) must be made can be significantly reduced. While one may suppose that such an arrangement would unacceptably reduce the joint strength, it has been found that the increased number of reduced depth crimps provides acceptable joint strength while greatly reducing the opportunity for joint failure due to severed plastic strap (under the crimp seal).

Those skilled in the art will recognize that the present invention has been described with reference to a side action crimp sealing tool, but that the invention is equally well applicable to known top action sealing tools as well.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A crimping tool for installing a metal crimp seal onto overlapping layers of plastic strap material, comprising:

a tool head;

at least three pairs of jaws disposed in the tool head and operably mounted thereto, each pair including opposingly oriented jaw elements, each pair being spaced from its adjacent pair; and at least two crimpers, each crimper disposed between adjacent pairs of jaw elements, the crimpers extending straight between the jaw elements, each crimper having a width defined by a front surface and a back surface of each crimper, and a bottom surface disposed between the front surface and the back surface of each crimper and across the width of each crimper, the bottom surface having a rounded profile across the width of each crimper designed to engage the metal crimp.

2. The crimping tool in accordance with claim 1 includes including three pairs of jaws, one being a central jaw pair and the others being terminal jaw pairs and including two crimpers, one crimper positioned between the central jaw pair and one of the terminal jaw pairs and the other crimper disposed between the central jaw pair and the other of the terminal jaw pairs.

3. The crimping tool in accordance with claim 1 including at least one tool operating handle operably connected to the tool head.

4. The crimping tool in accordance with claim 3 including a stationary handle and a tool operating handle, the handle handles being operably connected to the tool head.

5. The crimping tool in accordance with claim 4 including a linkage operably connecting each of the jaw elements of each pair of jaw elements and operably connecting each of the jaw element pairs, the linkage being operably connected to the tool operating handle.

* * * * *